US011767986B2

(12) United States Patent
Crisà

(10) Patent No.: US 11,767,986 B2
(45) Date of Patent: Sep. 26, 2023

(54) SYSTEMS FOR MOUNTING KITCHEN EXTRACTOR HOODS AND METHODS FOR EXECUTING THE MOUNTING

(71) Applicant: Elica S.p.A., Fabriano (IT)

(72) Inventor: Fabrizio Crisà, Fabriano (IT)

(73) Assignee: ELICA S.p.A., Fabriano (IT)

( * ) Notice: Subject to any disclaimer, the term of this patent is extended or adjusted under 35 U.S.C. 154(b) by 239 days.

(21) Appl. No.: 17/278,087

(22) PCT Filed: Sep. 20, 2019

(86) PCT No.: PCT/IB2019/057987
§ 371 (c)(1),
(2) Date: Mar. 19, 2021

(87) PCT Pub. No.: WO2020/065481
PCT Pub. Date: Apr. 2, 2020

(65) Prior Publication Data

US 2021/0348771 A1 Nov. 11, 2021

(30) Foreign Application Priority Data

Sep. 27, 2018 (IT) ..... 102018000008958

(51) Int. Cl.
*F24C 15/20* (2006.01)

(52) U.S. Cl.
CPC ..... *F24C 15/2071* (2013.01)

(58) Field of Classification Search
CPC ..... F24C 15/2071
See application file for complete search history.

(56) References Cited

U.S. PATENT DOCUMENTS 4,465,256 A * 8/1984 Wolbrink ..... A47B 77/08 312/278
4,614,177 A * 9/1986 Buckley ..... F24C 15/2071 126/299 R (Continued)

FOREIGN PATENT DOCUMENTS

DE 7429929 U 12/1974
DE 7530601 U 1/1976

(Continued)

OTHER PUBLICATIONS

International Search Report and Written Opinion in corresponding International Application No. PCT/IB2019/057987 dated Nov. 28, 2019, 11 pages.

(Continued)

*Primary Examiner* — Bayan Salone
(74) *Attorney, Agent, or Firm* — MH2 Technology Law Group LLP

(57) ABSTRACT

An assembly for mounting a kitchen extractor hood to a wall can include the kitchen extractor hood and a mounting system. The kitchen extractor hood can include: an extraction motor unit; filter devices; a channel to eject the extracted air; and a casing. The mounting system can include: a first frame secured to the wall, wherein the first frame is configured to support the extraction motor unit, wherein the first frame includes right-angled elements whose longer vertical sides are configured to be fixed to the wall by expansion means. The right-angled elements can include protruding overhanging shorter sides that form a bracket configured to support the extraction motor unit. The mounting system can further include: a second frame fixed to the first frame, wherein the second frame is configured to receive and hold the casing based on a position of the extraction motor unit on the bracket.

4 Claims, 3 Drawing Sheets

(56) References Cited

U.S. PATENT DOCUMENTS

| | | | | | |
|---|---|---|---|---|---|
| 4,659,047 | A * | 4/1987 | Haller | ..... | A47B 96/067<br>248/274.1 |
| 11,280,501 | B2 * | 3/2022 | Kim | ..... | F24F 13/10 |
| 2019/0309958 | A1 * | 10/2019 | Kim | ..... | F24C 15/20 |

FOREIGN PATENT DOCUMENTS

| | | | | | |
|---|---|---|---|---|---|
| DE | 2508920 | A1 | 9/1976 | | |
| DE | 102012016630 | A1 * | 2/2014 | ..... | B08B 15/02 |
| DE | 102012016630 | A1 | 2/2014 | | |
| EP | 3217099 | A1 * | 9/2017 | ..... | F24C 15/2071 |
| EP | 3217099 | A1 | 9/2017 | | |
| GB | 2283407 | A * | 5/1995 | ..... | A47B 46/00 |
| GB | 2283407 | A | 5/1995 | | |
| WO | WO-2018105966 | A1 * | 6/2018 | ..... | F24C 15/20 |
| WO | WO-2020065481 | A1 * | 4/2020 | ..... | F24C 15/2071 |

OTHER PUBLICATIONS

Italian Search Report and Written Opinion in corresponding Italian Application No. 102018000008958 dated May 15, 2019, 9 pages.

* cited by examiner

SYSTEMS FOR MOUNTING KITCHEN EXTRACTOR HOODS AND METHODS FOR EXECUTING THE MOUNTING

CROSS-REFERENCE TO RELATED APPLICATION(S)

This application is a national stage entry from International Application No. PCT/IB2019/057987, filed on Sep. 20, 2019, in the Receiving Office ("RO/IB") of the International Bureau of the World Intellectual Property Organization ("WIPO"), and published as International Publication No. WO 2020/065481 A1 on Apr. 2, 2020; International Application No. PCT/IB2019/057987 claims priority from Italian Patent Application No. 102018000008958, filed on Sep. 27, 2018, in the Italian Patent and Trademark Office ("IPTO"), the entire contents of all of which are incorporated herein by reference.

DESCRIPTION

Field of the Invention

The present invention relates to a system for mounting a kitchen extractor hood that forms part of kitchen furniture, as well as a mounting method using the system, as defined in the preamble of claims 1 and 4, respectively.

The invention particularly also relates to a system for mounting a kitchen extraction hood to a vertical wall of a kitchen between a pair of hanging cabinets.

Background Art

As is known in the art, wall-mounted kitchen hoods comprise a casing that can have various configurations including an inverted T-configuration, with the horizontal bar of the T-shape configured to contain the filter devices for filtering the extracted air and the vertical stem of the T-shape configured to contain the extraction motor unit and the channel for ejecting the extracted air which is conventionally designed for connection with the inlet of the chimney.

If the gas- or electrically-operated cooking household appliance is placed against the wall, next to other household appliances or worktops, a well-known problem consists in fixing its extractor hood above it.

U.S. Pat. No. 4,614,177 discloses a system for wall-mounting an extractor hood as defined in the preamble of claim 1. In particular, according to the system as disclosed by U.S. Pat. No. 4,614,177, a first frame is secured to the wall of the kitchen, and the casing of the extractor hood is fixed to the first frame by means of screws and bolts.

Prior Art Drawbacks

The above problem is further exacerbated in that kitchen furniture includes a series of hanging cabinets overhangingly arranged on the same wall of the kitchen and the kitchen hood has to fit between two contiguous hanging cabinets and, due to aesthetic reasons, its front part should be aligned with the profile of the contiguous hanging cabinets, so that its surface is coplanar with the doors of the latter.

The system as disclosed in U.S. Pat. No. 4,614,177 for wall-mounting an extractor hood does not always afford quick and easy mounting of the hood. This system requires at least two persons for hood installation. This is because, once the first frame has been secured to the kitchen wall, a first person should fix the hood casing to the first frame using screws and bolts and a second person should carry and hold the hood in the desired position. As a result, the extractor hood might require a very long installation time.

Object of the Invention

An object of the present invention is to provide a system for wall positioning of a kitchen extractor hood between hanging cabinets of a kitchen that affords alignment thereof with the hanging cabinets to form a substantially coplanar front surface therewith.

A further object of the present invention is to provide a system that affords easy and quick wall positioning of the extractor hood.

An object of the invention is also to provide a method of wall positioning of the kitchen extractor hood between hanging cabinets so that its front will be coplanar therewith.

These and other objects, as better explained hereafter, are fulfilled by the system for mounting a kitchen extractor hood to a vertical wall of a kitchen as defined in claim 1 hereinafter.

BRIEF DESCRIPTION OF THE DRAWINGS

The invention will be now described in greater detail with reference to a preferred embodiment thereof, given by way of illustration and without limitation, and shown in the annexed drawings, in which.

DETAILED DESCRIPTION

Figure 1:
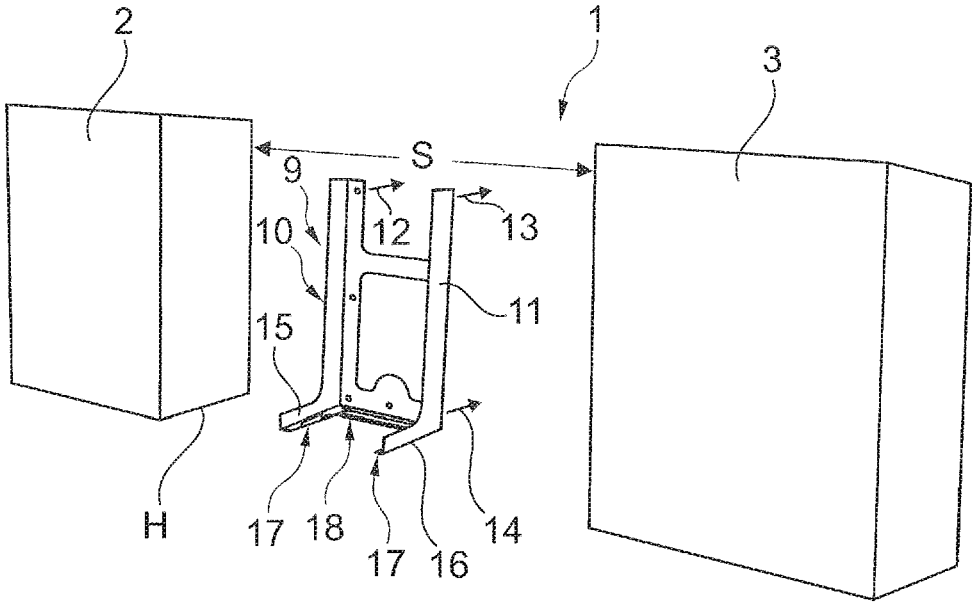
FIG. 1 shows a schematic perspective view of the first wall-mounted frame positioned between two conventional kitchen furniture hanging cabinets.

Referring to the above figures and particularly to FIG. 1, numeral 1 generally designates the wall of a kitchen furnished with conventional hanging elements (e.g., cabinets, referenced 2 and 3, mounted to the wall 1.

As is known in the art, these cabinets have a depth H of projection from the wall 1 that ranges from 50 to 60 cm, but is quite variable in its actual wall-mounted value.

Under the hanging elements 2 and 3, kitchen furniture typically includes various household appliances, not shown, or conventional cabinets with an overlying worktop, also not shown.

In the illustrated example, a space S is formed between the hanging elements 2 and 3 for receiving a wall-mounted extractor hood T associated with underlying cooker, not shown.

Figure 3:
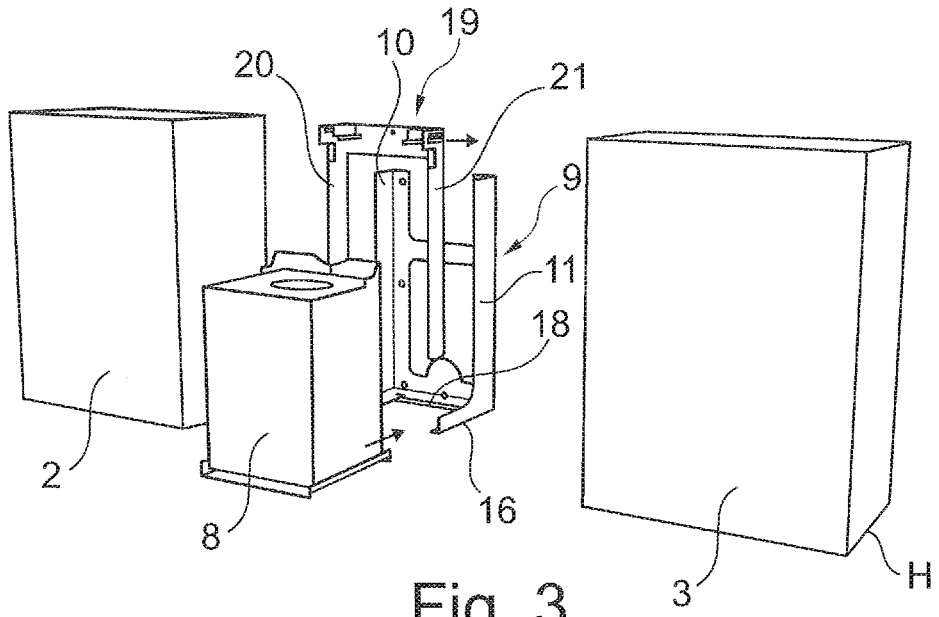
FIG. 3 shows a schematic perspective view of the second frame of the apparatus and the structure of the hood containing the extraction motor, as they are being positioned in the first frame.
Figure 4:
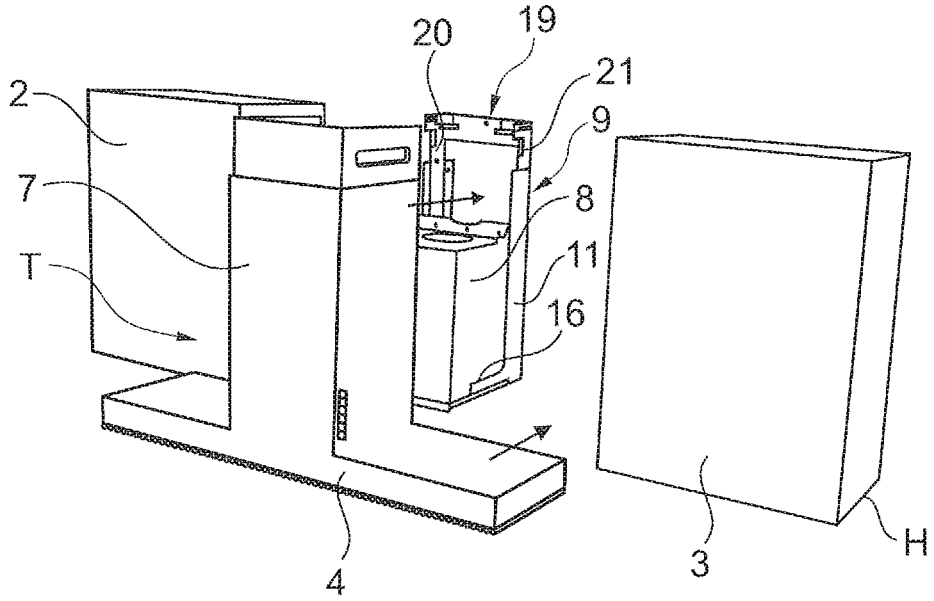
FIG. 4 shows a schematic perspective view of the casing of the hood as it is being positioned on the second and the first of said frames of the apparatus, between two hanging cabinets.
Figure 6:
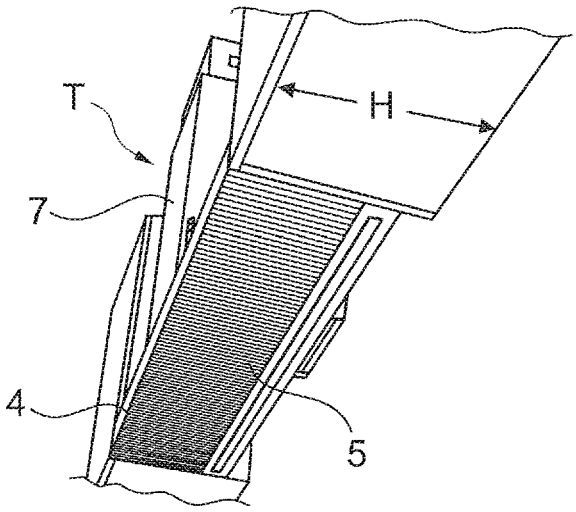
FIG. 6 shows a schematic perspective view of a wall-mounted extractor hood fitting among a plurality of hanging cabinets, illustrating the coplanar aligned arrangement so achieved.

According to the invention, the system for mounting a kitchen extractor hood to a vertical wall of a kitchen includes a hood T comprising filter devices for filtering the extracted air, referenced 5 in FIG. 6, an extraction motor unit with its extractor fan and a channel for ejecting the extracted air toward the chimney, generally referenced 8 in FIGS. 3 and 4.

The hood T comprises an inverted T-shaped casing, as schematically shown in FIG. 4. Such casing comprises a horizontal bar 4 configured to contain the filter devices 5 for filtering the extracted air and a vertical stem 7 configured to contain the extraction motor unit 8 and the channel for ejecting the extracted air.

According to the invention, the system for mounting a kitchen extractor hood to a vertical wall 1 of a kitchen comprises a first frame, generally referenced 9, as shown in FIG. 1.

Said first frame 9 is composed of right-angled elements 10 and 11 whose long vertical sides are adapted to be secured to the wall 1 by conventional means such as, for example, expansion bolts, schematically shown by the arrows 12, 13 and 14.

Therefore, the short sides 15 and 16 of the right-angled elements 10 and 11 project perpendicular to the wall 1, when the first frame 9 is secured thereto, and form a bracket 17 for the extraction motor unit 8.

The position of the extraction motor unit 8 on the bracket 17, relative to the wall 1 and thus based on the depth H of the hanging elements 2 and 3, is adapted by providing an adjustable projection 18 on the first frame 9 between the right-angled elements 10 and 11, near the short sides 15 and 16 of the right-angled elements 10 and 11.

More preferably, the adjustable projection 18 is placed between the short sides 15 and 16 of the right-angled elements 10 and 11.

Figure 2:
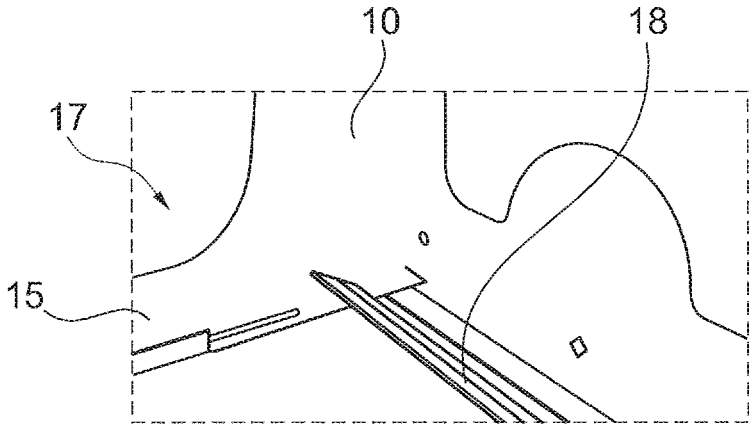
FIG. 2 shows a schematic perspective view of an enlarged detail of the frame of FIG. 1.

Such adjustable projection 18, as shown in an enlarged scale in FIG. 2, is formed, according to one embodiment, as a flat fin composed of a set of parallel adjacent segments defined by predetermined failure grooves, for removal of one or more of such segments, so that the projection of the fin relative to the right-angled elements 10 and 11 may be adjusted to obtain proper positioning of the extraction motor unit 8 on the bracket 17 relative to the wall 1, based on the depth H of the hanging cabinets, as better explained hereinafter.

According to the invention, a second frame, generally referenced 19, is connected to the first frame 9.

The second frame 19 is connected to the first frame 9 using conventional screw means, not shown, between the vertical right-angled elements 10 and 11 of the first frame 9 and the vertical elements 20 and 21 that comprise the second frame 19.

The position of the second frame 19 relative to the first frame 9 is determined by the requirement to accommodate and fix the casing of the hood T that covers the extraction motor unit 8 as a housing when the extraction motor unit 8 is already placed on the bracket 17. More preferably, the position of the second frame 19 relative to the first frame 9 is determined by the requirement to accommodate and fix the vertical stem 7 of the casing of the hood T.

Figure 5:
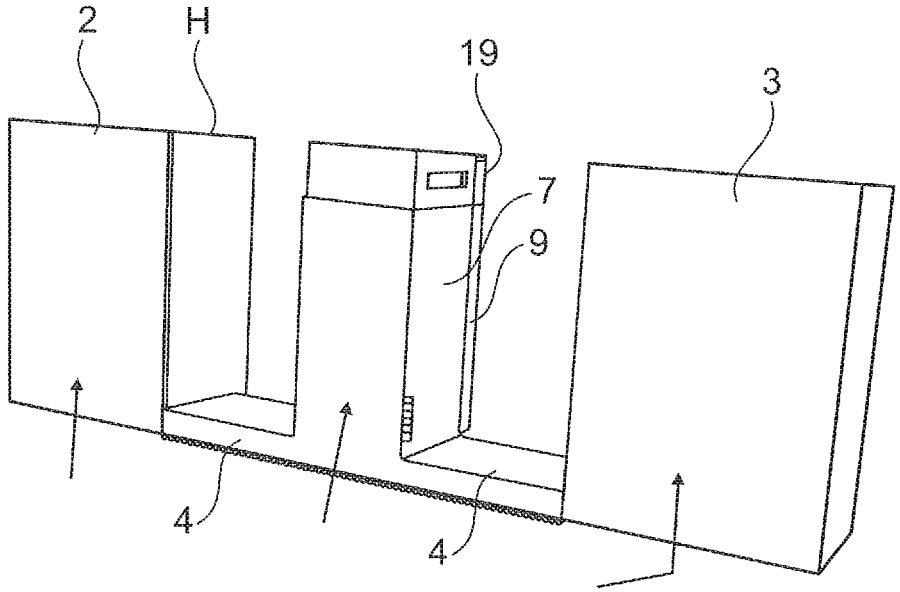
FIG. 5 shows a schematic perspective view of the extraction hood mounted between two hanging cabinets thereby forming a coplanar front surface.

With the provision of a first frame 9, a second frame 19, and the adjustable projection 18 on the first frame 9, whose depth dimensions are determined during installation of the first frame 9 on the wall 1, the position for the extraction motor unit 8 on the bracket 17, relative to the wall 1, may be determined with a high degree of accuracy, and the casing of the hood T, more preferably the vertical stem 7 of the casing, may be later positioned while ensuring coplanar arrangement thereof with the front surface of the hanging elements 2 and 3 as shown in FIGS. 5 and 6.

Advantageously, the bracket 17 affords quick and easy positioning of the extraction motor unit 8, whereby the extraction motor unit 8 may be fixed to the first frame 9 by a single person. Also, the second frame 19 affords quick and easy positioning of the casing of the hood T, whereby the casing of the hood T may be fixed to the second frame 19 by a single person. This is because fixation of the extraction motor unit 8 on the first frame 9 and fixation of the casing of the hood T on the second frame 19 do not require the use of screws and bolts whereby, once the first frame 9 and the second frame 19 have been secured to the vertical wall 1, the hood T may be quickly mounted to the vertical wall 1 of the kitchen.

Those skilled in the art will obviously appreciate that a number of changes and variants as described above may be made to fulfill particular requirements, without departure from the scope of the invention, as defined in the following claims.

The invention claimed is:

1. An assembly for mounting a kitchen extractor hood to a vertical wall of a kitchen between a pair of hanging cabinets of kitchen furniture, wherein the hanging cabinets have a given depth relative to a surface of the wall, the assembly comprising the kitchen extractor hood and a mounting system:

the kitchen extractor hood comprising:

an extraction motor unit configured to extract air from the kitchen;

filter devices configured to filter the extracted air;

a channel configured to eject the extracted air; and a casing configured to cover the extraction motor unit, the filter devices, and the channel, wherein the casing has an inverted-T shape, wherein the casing comprises a horizontal bar containing the filter devices, a vertical stem containing the extraction motor unit, and the channel; and the mounting system comprising:

a first frame secured to the vertical wall of the kitchen, between the pair of hanging cabinets, wherein the first frame is configured to support the extraction motor unit of the kitchen extractor hood, wherein the first frame comprises an adjustable projection for adjusting a position of the extraction motor unit relative to the wall, and wherein the first frame comprises right-angled elements whose longer vertical sides are configured to be fixed to the wall by expansion means;

wherein the right-angled elements of the first frame comprise protruding overhanging shorter sides, perpendicular to the wall of the kitchen, the shorter sides forming a bracket configured to support the extraction motor unit positioned on the bracket; and wherein the mounting system further comprises:

a second frame fixed to the first frame, wherein the second frame is configured to receive and hold the casing of the kitchen extractor hood based on a position of the extraction motor unit on the bracket with respect to the wall of the kitchen.

2. The assembly of claim 1, wherein the adjustable projection is between the shorter sides of the right-angled elements.

3. The assembly of claim 1, wherein the adjustable projection comprises a wing comprising an assembly of parallel sections in side-by-side relationship, with predetermined failure grooves for removal of one or more of the sections.

4. A method of fixing an assembly for mounting a kitchen extractor hood to a wall of a kitchen between a pair of hanging cabinets of kitchen furniture, wherein the hanging cabinets have a given depth relative to a surface of the wall of the kitchen to achieve coplanar alignment of a front surface of the kitchen extractor hood with a front of the hanging cabinets, the method comprising:

providing a first frame of a mounting system having a bracket and an adjustable projection for adjusting an extent of overhang of the bracket relative to the wall;

applying and fixing the first frame to the wall;

adjusting the adjustable projection according to the given depth of the hanging cabinets;

providing the kitchen extractor hood comprising an extraction motor unit configured to extract air from the kitchen, filter devices configured to filter the extracted air, a channel configured to eject the extracted air, and a casing configured to cover the extraction motor unit, the filter devices, and the channel, wherein the casing has an inverted T-shape, wherein the casing comprises a horizontal bar containing the filter devices, a vertical stem containing the extraction motor unit, and the channel;

placing the extraction motor unit of the kitchen extractor hood on the adjusted overhang of the bracket;

providing a second frame of the mounting system having elements configured to receive and hold the casing of the kitchen extractor hood;

placing the second frame on the first frame, and fixing the second frame to the first frame; and applying the casing of the kitchen extractor hood on the second frame.

* * * * *